US007326042B2

(12) United States Patent
Alper et al.

(10) Patent No.: US 7,326,042 B2
(45) Date of Patent: Feb. 5, 2008

(54) APPARATUS FOR PACKAGING HOT MELT ADHESIVES USING A MOLD AND CARRIER

(75) Inventors: Mark Alper, Mukwonago, WI (US); Atul Mehta, New Berlin, WI (US)

(73) Assignee: Bostik Findley, Inc., Wauwatosa, WI (US)

( * ) Notice: Subject to any disclaimer, the term of this patent is extended or adjusted under 35 U.S.C. 154(b) by 127 days.

(21) Appl. No.: 10/329,191

(22) Filed: Dec. 24, 2002

(65) Prior Publication Data

US 2004/0119198 A1 Jun. 24, 2004

(51) Int. Cl.
*B29C 39/26* (2006.01)

(52) U.S. Cl. ..... 425/127; 425/DIG. 9

(58) Field of Classification Search ..... 425/127, 425/DIG. 9

See application file for complete search history.

(56) References Cited

U.S. PATENT DOCUMENTS

| | | | | |
|---|---|---|---|---|
| 2,328,798 A | | 9/1943 | Gardner | 206/84 |
| 2,639,808 A | | 5/1953 | Barry et al. | 206/84 |
| 2,762,504 A | | 9/1956 | Sparks et al. | 206/84 |
| 3,314,536 A | | 4/1967 | Janota et al. | 206/84 |
| 3,564,808 A | | 2/1971 | Kent | 53/25 |
| 3,837,778 A | | 9/1974 | Parker | 425/256 |
| 4,137,692 A | | 2/1979 | Levy | 53/440 |
| 4,200,481 A | | 4/1980 | Faller | 156/382 |
| 4,748,796 A | | 6/1988 | Viel | 53/411 |
| 4,755,245 A | | 7/1988 | Viel | 156/227 |
| 4,886,634 A | * | 12/1989 | Strutzel et al. | 264/560 |
| 5,160,686 A | | 11/1992 | Thaler et al. | 264/255 |
| 5,257,491 A | | 11/1993 | Rouyer et al. | 53/428 |
| 5,333,439 A | | 8/1994 | Bozich et al. | 53/450 |
| 5,373,682 A | | 12/1994 | Hatfield et al. | 53/440 |
| 5,392,592 A | | 2/1995 | Bozich et al. | 53/440 |
| 5,401,455 A | | 3/1995 | Hatfield et al. | 264/255 |
| 5,715,654 A | | 2/1998 | Taylor et al. | 53/440 |

(Continued)

FOREIGN PATENT DOCUMENTS

JP 11-300748 * 11/1999

(Continued)

*Primary Examiner*—Edmund H. Lee
(74) *Attorney, Agent, or Firm*—Andrus, Sceales, Starke & Sawall, LLP

(57) ABSTRACT

A dual component molding assembly for packaging hot melt adhesives wherein a mold, preferably in the form of an open top pan, includes a cavity which is lined with a thin film of plastic material. The mold has openings formed therein which communicate with the cavity to facilitate vacuum forming of the film to the cavity's interior surface. The second component is a carrier for the mold and is also preferably in the form of an open top pan. The carrier also includes a cavity for receiving the mold, and functions not only to support the mold when nested therein, but also to act as a heat sink to effectively and rapidly remove, dissipate or absorb the heat from molten adhesive dispensed into the mold. After filling the mold with a mass of adhesive, the exposed open top surface of the adhesive is covered with a second layer of thin film of plastic material which is then sealed to the first film lining the interior of the mold. After cooling, the packaged adhesive is cut adjacent the seal to form individual adhesive blocks for further processing.

8 Claims, 4 Drawing Sheets

U.S. PATENT DOCUMENTS

| | | | | |
|---|---|---|---|---|
| 5,725,820 | A | 3/1998 | Reynolds et al. | 264/135 |
| 5,806,285 | A | 9/1998 | Rizzieri | 53/453 |
| 5,869,555 | A | 2/1999 | Simmons et al. | 524/229 |
| RE36,177 | E | 4/1999 | Rouyer et al. | 53/428 |
| 5,942,569 | A | 8/1999 | Simmons et al. | 524/487 |
| 5,987,852 | A | 11/1999 | Bozich et al. | 53/440 |
| 6,138,441 | A | 10/2000 | Kik et al. | 53/440 |
| 6,155,029 | A | 12/2000 | Jain | 53/440 |

FOREIGN PATENT DOCUMENTS

| | | |
|---|---|---|
| WO | WO 93/23224 | 11/1993 |
| WO | WO 00/34129 | 6/2000 |

* cited by examiner

APPARATUS FOR PACKAGING HOT MELT ADHESIVES USING A MOLD AND CARRIER

BACKGROUND OF THE INVENTION

The present invention relates to a method for packaging adhesives, and more particularly to a method for packaging hot melt adhesives in a pan and the resulting package formed thereby.

Hot melt adhesives are substantially solid at room temperature, but are applied in a molten or flowable state. Typically, hot melt adhesives are supplied in the form of solid blocks, pillows or pellets contained within a package that is meltable together with and blendable into the molten adhesive composition itself just prior to application. However, providing hot melt adhesives in these forms has unique problems, especially if the hot melt adhesive is pressure-sensitive. Since such substances are inherently sticky or soft at room temperature, there are problems associated with handling and packaging. Regardless of the form in which it is provided, a pressure sensitive adhesive not only sticks or adheres to hands, mechanical handling devices and to itself, but it also picks up dirt and other contaminates. In addition, adhesives with relatively low softening points will tend to flow or block together into a single solid mass rendering such adhesives difficult to be handled and/or packaged. Additionally, pressure sensitive formulations may deform or cold flow unless supported during shipment.

Many different approaches have been tried to package pressure sensitive hot melt adhesives. For example, U.S. Pat. No. 5,806,285 to Rizzieri teaches a method wherein adhesive is cast in a mold to form blocks. The mold has a plurality of holes formed therein and is lined with a thin film of plastic material which is vacuum thermoformed onto the inner surface of the mold. After filling the mold with adhesive, the free top surface is covered with a thin film of plastic material which is heat sealed to the film lining the interior of the mold. The mold containing the adhesive which is now enveloped by the film is then air cooled prior to removing the packaged adhesive from the mold. The major disadvantage of this process is that it cannot be water cooled due to the openings in the mold. The openings in the mold are necessary for the vacuum forming operation, and any attempt to water cool the mold would result in the adhesive floating out of the mold since hot melt adhesives are generally less dense than water. Due to the necessity of air cooling, the Rizzieri method is extremely slow in commercial production and requires a tremendous amount of time and space. In addition, since air is a relatively poor heat sink, this limits the temperature at which the hot melt adhesive can be dispensed into the mold. If the adhesive is dispensed into the mold at too high of temperature, it will melt the film. Thus, the Rizzieri technique is relatively slow and as such has limited applications.

Another process using molds is taught in U.S. Pat. No. 5,401,455 to Hatfield et al. The Hatfield et al patent teaches a method for packaging hot melt adhesive compositions using a solid mold in the form of a pan which has its outer surface in contact with a refrigerant gas or liquid heat sink. Hatfield et al teaches that when molten hot melt adhesive is poured into a cavity of the mold lined with film, the adhesive is fused to some degree with the film. According to Hatfield et al, this in turn improves later mixing of the film with the adhesive. However, a major disadvantage of Hatfield et al is that it is extremely difficult to consistently line the inner surface of a solid pan-like mold with a film so that the film does not wrinkle, crease or create voids between the film and the inner surface of the mold. If a continuous roll of film is used, the slightest movement of the film would cause the film to wrinkle resulting in voids or gaps between the film and the inner surface of the mold. It is desirable to avoid such gaps as they can cause burnthrough of the film. Thus, once again, the Hatfield et al method is extremely slow in commercial production, and has numerous technical problems that are difficult to overcome.

Yet another process utilizing a mold is disclosed in U.S. Pat. No. 5,715,654 to Taylor et al. In this process, Taylor et al teaches lining a rigid mold with a thermoplastic film which can be vacuum formed into the mold. However, if it is vacuum formed, the same cooling issues exist as in the Rizzieri method discussed above. In an attempt to speed up cooling, Taylor et al teaches that the center of the adhesive mass in the mold should be less than 1 inch from the nearest surface of the mold. The major disadvantage of such a mold is that it would produce a very small unit of adhesive. It would be preferable to have a method which would produce larger units such as blocks of adhesive. In addition, since there is no water cooling, the adhesive in Taylor et al would have to be dispensed into the mold at a relatively low temperature to prevent the film from melting. Again, since Taylor et al does not use water as a cooling medium, Taylor et al's process would be a very slow method, and thus would have limited commercial value.

SUMMARY OF THE INVENTION

The present invention utilizes a dual component molding assembly wherein a mold, preferably in the form of an open top pan, includes a cavity which is lined with a thin film of plastic material. The mold has openings formed therein which communicate with the cavity to facilitate vacuum forming of the film to the cavity's interior surface. The second component is a carrier for the mold and is also preferably in the form of an open top pan. The carrier also includes a cavity for receiving the mold, and functions not only to support the mold when nested therein, but also to act as a heat sink to effectively and rapidly remove, dissipate or absorb the heat from molten adhesive dispensed into the mold.

In a first embodiment wherein the carrier is an open top pan, the outer surface of this second pan directly contacts a cooling medium such as water. In a second embodiment wherein the carrier is a block or core member containing a network of internal passageways, a cooling medium such as water is passed through the passageways to remove heat. In a third embodiment, the carrier is a jacketed core member and cooling medium such as water is passed therethrough to remove heat. At the same time, the nesting of the mold in the carrier assures a high degree of heat transfer between the mold, the carrier, and the cooling medium. In this way, all the advantages of vacuum and/or thermoforming can be used to line the first pan, and these advantages can be combined with the advantages of using water and/or other liquids as the preferred efficient cooling medium.

After filling the mold with a mass of adhesive, the exposed open top surface of the adhesive is covered with a second layer of thin film of plastic material which is then sealed to the first film lining the interior of the mold. The two films may be composed of the same or different materials depending upon the adhesive's end use.

An advantage of this dual component molding arrangement is that it can be used with any type of hot melt adhesive composition, and particularly a pressure-sensitive hot melt. Another advantage is that any thermoplastic film can be used as the first film to line the mold or as the second film to cover the adhesive so long as the films are meltable together with and are compatible with the adhesive composition. Thus, the films should not substantially adversely affect the adhesive characteristics of a molten mixture of the adhesive and film material or substantially adversely impact the operation of hot melt application equipment. Yet another advantage involves cleanliness, i.e. the mold does not contact the cooling medium. Therefore, any scum, insects, dirt, glue, or other contaminants that may be floating in the cooling medium do not adhere to its outer surface. As a result, the mold remains relatively clean for extended periods of use.

BRIEF DESCRIPTION OF THE DRAWINGS

The drawings illustrate the best mode presently contemplated of carrying out the invention.

In the drawings.

DETAILED DESCRIPTION OF THE INVENTION

The present invention is directed to a dual component molding assembly for packaging-hot melt adhesives and to a method of packaging hot melt adhesives using the dual component molding assembly. In particular, the method comprises the steps of:

providing a mold having a cavity, the cavity having an exposed open top;

lining the cavity with a film of thermoplastic material;

placing the lined mold into a carrier to provide a dual component molding assembly;

subjecting the dual component molding assembly to a cooling medium;

filling the cavity with a desired amount of a mass of molten hot melt adhesive wherein the mass of adhesive has an exposed face; and cooling the adhesive to a desired temperature.

The present invention is preferably directed to a dual pan molding assembly for packaging hot melt adhesives and to a method of packaging hot melt adhesives using the dual pan assembly. In particular, the method comprises the steps of:

providing a first pan having a first cavity, the first cavity having an exposed open top;

lining the first cavity with a first thin film of thermoplastic material;

placing the lined first pan into a second pan to provide a dual pan molding assembly;

subjecting the dual pan molding assembly to a cooling medium;

filling the first cavity with a desired amount of a mass of molten hot melt adhesive wherein the mass of adhesive has an exposed face; and cooling the adhesive to a desired temperature.

Optionally, but preferably, the exposed face of the mass of adhesive is enclosed to provide a packaged unit of adhesive. Enclosing the exposed face of the adhesive may be accomplished by covering the open top of the first cavity with a second thin film or layer of thermoplastic material and sealing the second thin film to the first thin film.

Alternately, rather than covering each first pan with a second thin film, a pair of first pans each containing adhesive may be placed in a mating face-to-face relationship, i.e. open top to open top so that only the first film surrounds the adhesive. Although the tackiness of the adhesive will cause the two pans to stick or adhere together and form a single unit or block of adhesive, it may be desirable with adhesives that readily cold flow to seal the peripheral edges of the first thin film to each other.

Figure 1:
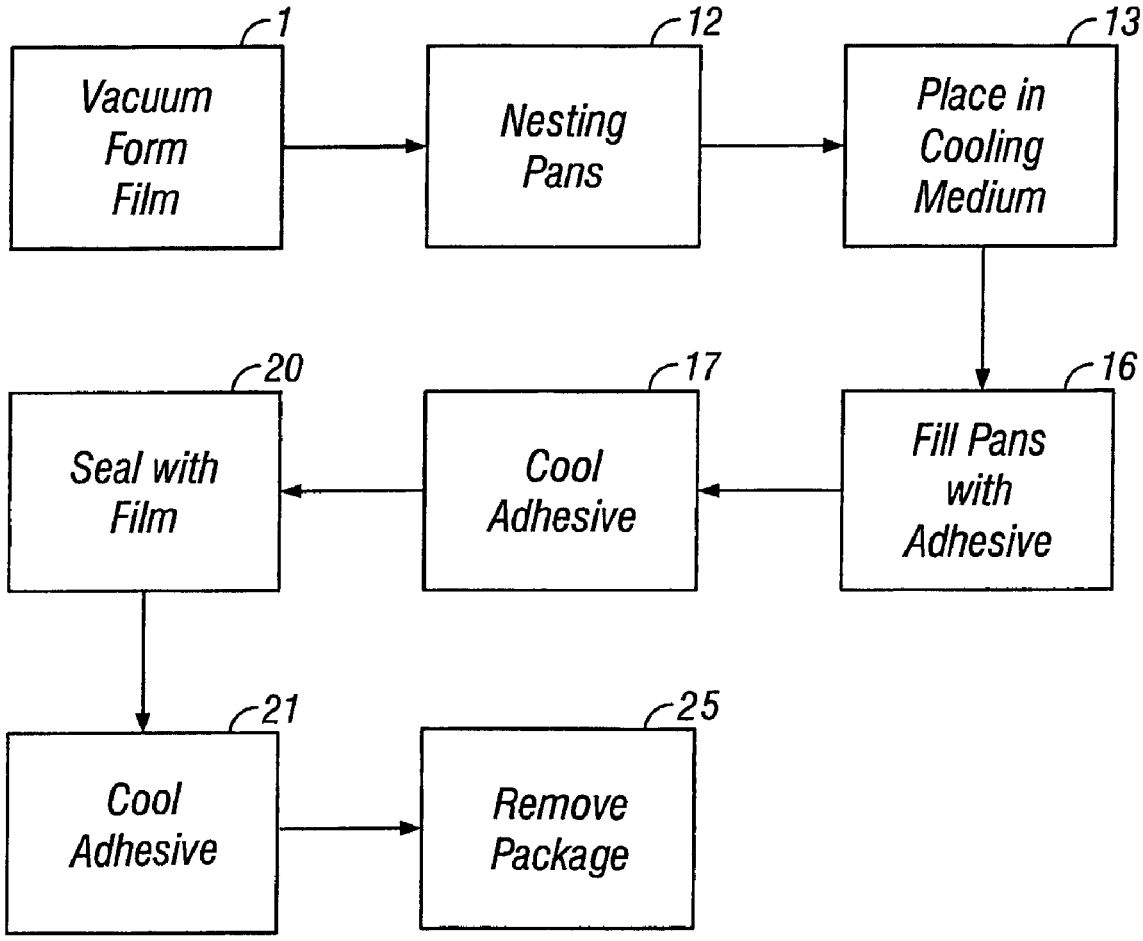
FIG. 1 is a block diagram illustrating the steps in the dual component molding process according to the present invention for packaging hot melt adhesives.

The method of the present invention is schematically illustrated via the flow diagram of FIG. 1. The first step in the method of packaging hot melt adhesives in accordance with the present invention is schematically illustrated by box 1. This step comprises providing a first rigid mold or pan 3 composed of a thermally conductive material such as aluminum and having a cavity with perforated walls (hereinafter to be described) and lining the first rigid pan or mold with a first thermoplastic thin film such that the interface between the inner surface of the cavity of the pan or mold and the film itself is substantially free of creases, wrinkles and/or voids. Preferably, the film is vacuum formed to the interior of the pan or mold. In order to accomplish this, reference is made to FIG. 2 which illustrates an inner tray 2 having a plurality of pans or molds 3 formed therein. In the embodiment illustrated, there are six pans or molds 3 uniformly distributed in tray 2. Typically, tray 2 would include two spaced pans extending widthwise and three pans lengthwise therein. Thus, there will ultimately be formed six individual packages of adhesive per tray 2 (see for example FIG. 3). However, there is nothing critical about the number of pans or molds per tray, and therefore each tray could contain more e.g. 8, 10, 12, 16, etc., or less e.g. 4, 2, etc. than the number specifically illustrated herein. Also, individual pans 3 could be used without tray 2 if desired. The only limiting factors are the size of each individual package of adhesive desired, the width of water trough, or other equipment parameters, etc as is well understood by those skilled in this art.

As illustrated, inner tray 2 includes a substantially planar top portion 4 and a plurality of pans 3 spaced from each other forming cavities or molds depending from the underside of top portion 4. Each pan 3 includes an inner surface 5 and an outer surface 6 that defines a cavity for receiving the hot melt adhesive. As shown best in FIG. 2, the sidewalls of each pan 3 are disposed at an acute angle with respect to top portion 4, and the bottom wall thereof is substantially parallel to top portion 4. As also-illustrated in FIG. 2, the sidewalls and bottom wall of each pan 3 includes a plurality of openings 7 formed therethrough. Openings 7 may be randomly or uniformly disposed through the sidewalls and bottom wall of each pan 3, and function to enable an inner thin film 8 of thermoplastic material to be vacuum formed against the inner surface 5 of each pan 3 in such a manner that the interface between the inner surface 5 and the film 8 is substantially free of voids, creases and/or wrinkles.

In order to accomplish this, the inner thin film 8 of thermoplastic material may be fed through a series of idlers and web guides to insure that the film is properly tensioned and aligned with respect to tray 2. The film 8 can be supplied in roll form or it can be made inline by any film forming process immediately prior to being used to line pan 3. In any event, film 8 is disposed on top of tray 2, and is thereafter formed to the interior of the cavity of each pan 3 by applying a vacuum externally of outer surface 6. This vacuum results in film 8 being pulled down into and vacuum formed to the inner surface 5 of each pan 3.

In some circumstances, and depending particularly upon the film composition and pan configuration, it may be desirable to heat the film 8 just prior to lining the pan 3. Thus, the film 8 may be deposited into the pan 3 using vacuum, heat or a combination of vacuum and heat. Other means for depositing film 8 within pan 3 are also contemplated, such as using a plunger or some other mechanical assist, or via an electrostatic system.

The inner tray 2 is then conveyed to a location wherein it is inserted within or nested within a second outer tray 9. Outer tray 9 has substantially the same dimensions as inner tray 2, and includes a plurality of corresponding second open top pans 10 disposed at substantially the same locations and having substantially the same dimensions as pans 3 so that pans 3 can nest within pans 10 to provide a dual pan assembly, as illustrated best in FIG. 2. Each pan 10 formed in outer tray 9 defines a cavity for receiving a pan 3 and has a bottom wall and side walls that are solid, as illustrated best in FIG. 2. Thus, the top portion 11 as well as the angled sidewalls and flat bottom wall of each pan 10 substantially conform to like components of inner tray 2 to insure that effective and rapid heat transfer between pans 3 and 10 takes place. This step in the process is illustrated by box 12 in FIG. 1.

Figure 2:
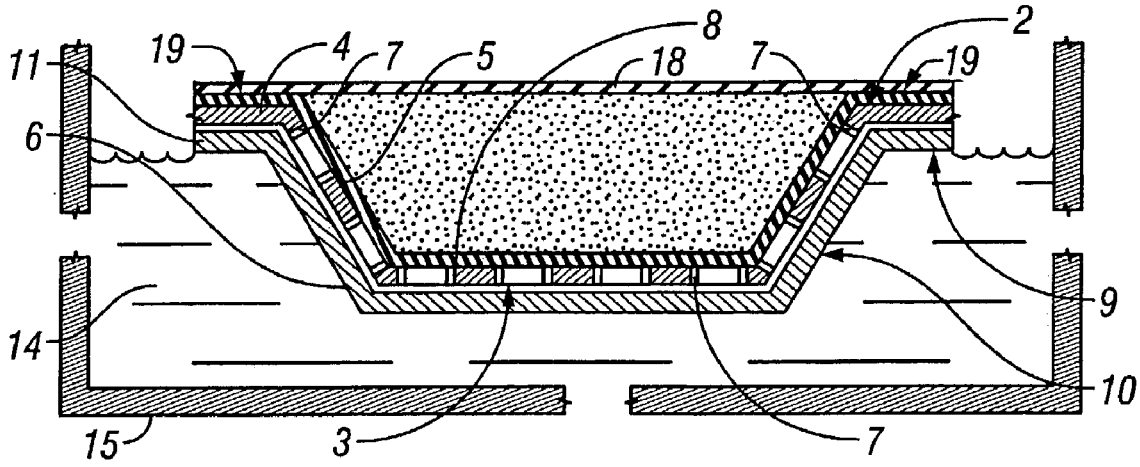
FIG. 2 is a cross-sectional view illustrating a first embodiment of the present invention in the form of a pan and carrier assembly wherein the carrier is a second pan having its external surface in direct contact with cooling water.

Box 13 in FIG. 1 illustrates that the next step in the present packaging method is to place the dual pan assembly illustrated in FIG. 2 into a liquid cooling medium designated 14 in FIG. 2. The liquid cooling medium 14 preferably comprises any liquid which will effectively and rapidly remove, dissipate or absorb the heat from the molten adhesive within pan 3 and the film in contact with the molten hot melt adhesive composition so as to rapidly cool the adhesive and to also prevent the temperature of the film 8 from exceeding its melting point even though the temperature of the molten hot melt adhesive composition may be higher than the film melting temperature. The preferred liquid cooling medium is water although other liquids could be utilized. As shown as best in FIG. 2, the liquid cooling medium 14 is contained by a trough 15 which is dimensioned to accommodate trays 2 and 9 as well as to contain sufficient liquid to accomplish cooling of film 8 and the hot melt adhesive composition contained within pans 3.

The next step in the process is to fill pans 3 with molten hot melt adhesive, which is illustrated by box 16. Thus, after the dual pan arrangement illustrated in FIG. 2 is placed into liquid cooling medium 14, the dual pan assembly is conveyed to a filling station having at least one filling head which dispenses a molten thermoplastic hot melt adhesive composition at a temperature of from about 65.5° C. (150° F.) to 204.4° C. (400° F.) into the lined cavity of pan 3. Preferably, the filling station is located above the pans 3 such that the thermoplastic adhesive composition can be dispensed by gravity. Each pan 3 is filled with a desired amount of adhesive, as best illustrated in FIG. 2.

As illustrated by box 17 in FIG. 1, the dual pan assembly is then conveyed downstream in trough 15 such that pan 10 is in constant contact with liquid cooling medium 14 to provide initial cooling of the adhesive within pans 3 until at least the surface of the adhesive mass contained in pans 3 have sufficiently cooled to a desired temperature, i.e. about 37.7° C. (100° F.) to about 149° C. (300° F.). Typically, this temperature is such that the molten adhesive composition will not melt a second outer thin film 18 of thermoplastic material which is dispensed on the top surface thereof. This second outer thin film 18 covers the open top surface of the adhesive composition as shown best in FIG. 2.

After the outer thin film 18 is disposed on top of tray 2 to cover pans 3 and the adhesive contained therein, a plurality of crosswise seals 37 and lengthwise seals 38 are made between the inner thin film 8 and outer thin film 18. Seals 37 and 38 are formed adjacent the peripheral edges of pans 3 such that the thermoplastic adhesive composition is substantially enclosed on all six sides thereof. Sealing the inner film 8 to the outer film 18 can be achieved by various methods including heat sealing, ultrasonic bonding or adhesive bonding. Seals 37 and 38 are shown best in FIG. 3, and the step of sealing is illustrated by box 20 in FIG. 1. It should be noted that second film 18 can have the same thickness as film 8, or film 18 can be thicker or thinner than film 8. Also, it should be noted that initial cooling of the adhesive and films 8, 18 is actually accomplished via a combination of the liquid cooling medium 14 in contact with the outer surface of pan 10 and air in contact with the open surface of the adhesive within pan 3. Obviously, substantially most of the cooling is provided by cooling medium 14 which functions as the primary heat sink both during this initial cooling step as well as in the later final cooling of the adhesive.

As illustrated by box 21 in FIG. 1, the dual pan assembly is then conveyed downstream within trough 15 in a final cooling step until the adhesive cools to a temperature of about 10° C. (50° F.) to about 65.5° C. (150° F.). It should be noted that the outer surface of pans 10 remains in constant contact with cooling medium 14 during this time to provide maximum cooling of the adhesive. Obviously, the time spent in trough 15 depends upon the temperature of the cooling medium 14, the flow rate of the dual pan assembly in trough 15 and the desired end temperature for the adhesive.

Figure 3:
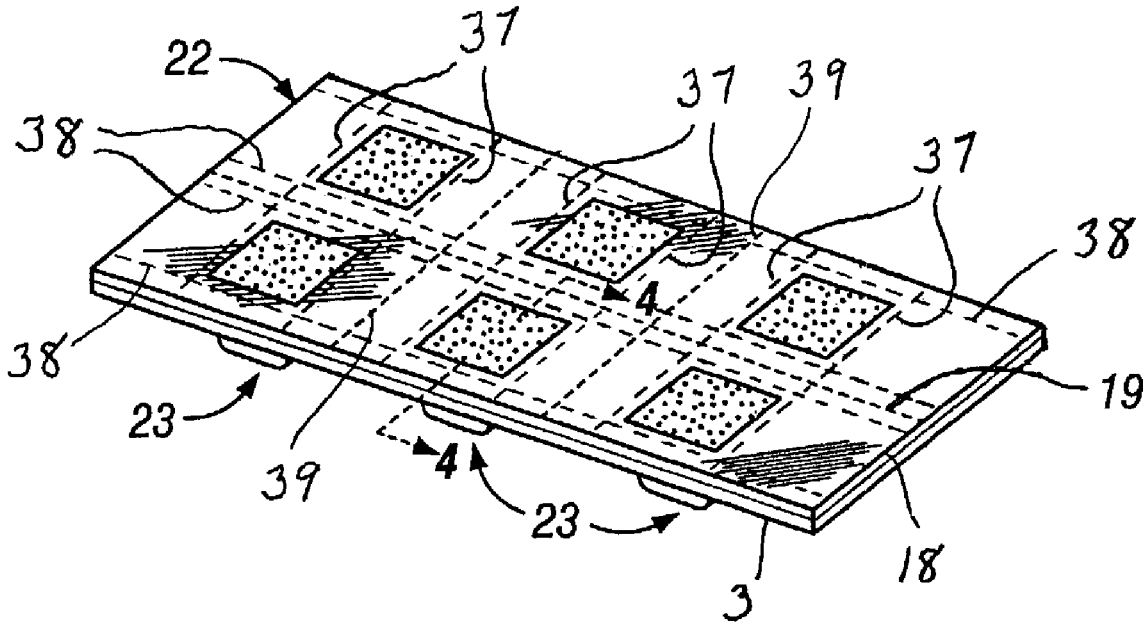
FIG. 3 is a perspective view of an inner tray provided with six pans each of which is lined with a first plastic film, filled with hot melt adhesive, and covered by a second sheet or layer of plastic film.
Figure 4:
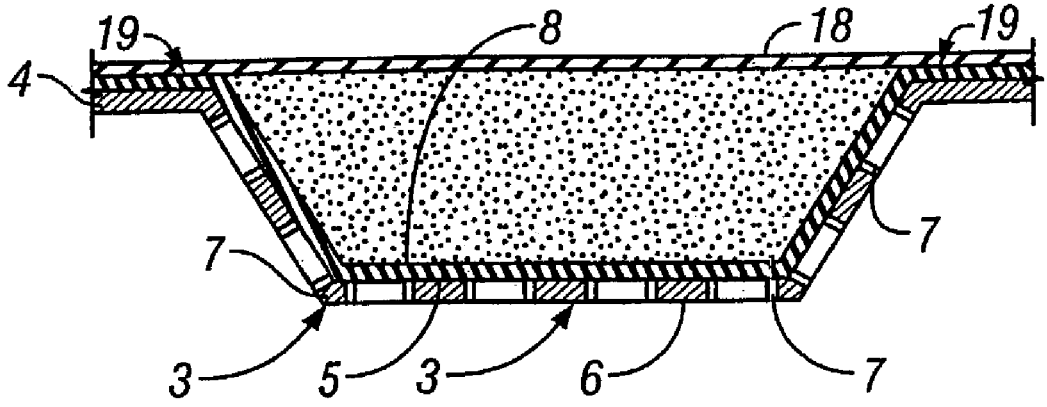
FIG. 4 is a cross-sectional view taken along the line 4-4 in FIG. 3.

As illustrated by box 25 in FIG. 1, once the adhesive composition is sufficiently cooled, the inner tray 2 is removed from outer tray 9 and the assembly 22 is removed from inner tray 2. Assembly 22 comprises the outer thin film 18 sealed to the inner thin film 8 and a plurality, i.e. six as illustrated in FIG. 3, of adhesive unit packages designated as 23. The assembly 22 and the plurality of integral adhesive unit packages 23 is then conveyed to a cutter that cuts the assembly 22 into six individual unit packages 23. As shown best in FIG. 3, a longitudinal cut 19 is made between adjacent longitudinal seals 38 and a pair of cross cuts 39 are made between adjacent crosswise seals 37 to form the six individual packages 23. The cuts 19 and 39 may be accomplished by any known means, such as a razor knife slitter, a mechanical scissors, a slitter wheel, laser cutters, a heated wire, etc. Once the individual packages 23 of thermoplastic adhesive material have been separated, they can be placed into a box or other shipping container, either manually or via an automated packaging system.

As previously mentioned, an alternative method involves the optional elimination of using the second outer film 18 as well as the steps illustrated by box 20 in FIG. 1, i.e. covering the open top of pan 3 with a second outer film 18 and sealing the film 18 to the first inner film 8. In this method, the initial and final cooling steps are combined into one single step. Thus, after the adhesive is cooled to its final temperature in trough 15, the assembly 22 (without film 18) is removed from tray 2 and folded lengthwise so that the adhesive is disposed face-to-face, i.e. open top to open top so that only the inner first film surrounds the adhesive. Although the tackiness of the adhesive will cause two unit packages 23 to stick together and form a single larger unit or block of adhesive, it may be desirable with adhesives that readily cold flow to seal the peripheral edges of the inner or first film 8 to each other. The combined blocks of adhesive are then cut transversely to form individual packages of adhesive.

Hot Melt Adhesive

The method and dual pan assembly of the present invention is adaptable to the packaging of virtually any type of hot melt adhesive composition. It is especially adapted to the packaging of thermoplastic or thermosetting pressure sensitive adhesives where the handling problems are most severe. As is well known, hot melt adhesives comprise a blend of various compatible ingredients and typically includes a blend of a polymer and/or copolymer, tackifying resin, plasticizer, wax and an antioxidant. Examples of typical formulations can be found in U.S. Pat. No. 5,149,741 and U.S. Reissue Pat. No. 36,177 the disclosures of which are both incorporated herein by reference.

Any of a variety of well known and readily available thermosetting materials can be used as the polymer, copolymer or in blends of polymers and/or copolymers in the adhesive compositions. Examples of such materials include polyacrylates, polyesters, polyurethanes, polyepoxides, graft copolymers of one or more vinyl monomers and polyalkylene oxide polymers, aldehyde containing resins such as phenol-aldehyde, urea-aldehyde, melamine-aldehyde and the like, as well as polyimides.

Any of a variety of well known and readily available thermoplastic materials can also be used as the polymer, copolymer or in blends of polymers and/or copolymers in the adhesive compositions. Examples of such materials include ethylene based polymers, including ethylene vinyl acetate, ethylene acrylate, ethylene methacrylate, ethylene methyl acrylate, ethylene methyl methacrylate, an ethylene-styrene interpolymer (ESI), an ethylene acrylic acid, ethylene vinyl acetate carbon monoxide, and ethylene N-butyl acrylate carbon monoxide; polybutene-1 polymers; polyolefins such as high and low density polyethylene; polyethylene blends and chemically modified polyethylene, copolymers of ethylene and $C_1$-$C_6$ mono- or di-unsaturated monomers; polyamides; polybutadiene rubber; polyesters such as polyethylene terephthalate, and polybutylene terephthalate; thermoplastic polycarbonates; atactic polyalphaolefins, including atactic polypropylene, polyvinylmethylether and others; thermoplastic polyacrylamides, such as polyacrylonitrile, and copolymers of acrylonitrile and other monomers such as butadiene styrene; polymethyl pentene; polyphenylene sulfide; aromatic polyurethanes; polyvinyl alcohols and copolymers thereof; polyvinyl acetate and random copolymers thereof; styrene-acrylonitrile, acrylonitrile-butadiene-styrene, styrene-butadiene rubbers, acrylonitrile-butadiene-styrene elastomers, A-B, A-B-A, A-$(B\text{-}A)_n$-B, $(A\text{-}B)_n$-Y block copolymers wherein the A block comprises a polyvinyl aromatic block such as polystyrene, the B block comprises a rubbery midblock which can be polyisoprene, and optionally hydrogenated, such as polybutadiene, Y comprises a multivalent compound, and n is an integer of at least 3, and mixtures of said substances. Examples of these latter block copolymers including styrene-butadiene, styrene-butadiene-styrene, styrene-isoprene-styrene, styrene-ethylene-butylene-styrene and styrene-ethylene propylene-styrene.

While the total styrene content of the polymers can be as much as 51 wt-% of the polymer, and since the polymers can have more than two A blocks for optimal performance, the total A block should be less than or equal to about 45 wt-% of the polymers, and, most preferably, is less than or equal to 35 wt-% of the polymer. In an S-B-S (styrene-butadiene-styrene) copolymer, the preferred molecular weight is about 50,000 to 120,000, and the preferred styrene content is about 20 to 45 wt-%. In an S-I-S (styrene-isoprene-styrene) copolymer, the preferred molecular weight is about 100,000 to 200,000 and the preferred styrene content is about 14-35 wt-%. Hydrogenating the butadiene midblocks produces rubbery midblocks that are typically converted to ethylene-butylene midblocks.

Such block copolymers are available from Kraton Polymers, Enichem, Fina and Dexco. Multiblock or tapered block copolymers (the A-$(B\text{-}A)_n$-B type) are available from Firestone.

Other polymers that could be used are syndiotactic polypropylene (SPP) polymers or isotactic polypropylene random copolymers (RCP) and/or blends of SPP or RCP with amorphous atactic poly-α-olefins (APAO), all of which are well known in this art. The SPP polymers are essentially high molecular weight stereospecific propylene homopolymers or copolymers of propylene with other α-olefin monomers such as ethylene, butene-1 or hexene-1. RCPs comprise a random copolymer of propylene and an α-olefin having the formula $R—CH{=}CH_2$ where R is hydrogen or a $C_2$ to $C_{10}$ alkyl group, preferably ethylene. The useful RCP polymers for the present invention are preferably metallocene catalyzed (mRCP) and will contain at least 1.5% by weight of the said α-olefin comonomer, and having a melting point of 145° C. or lower, as measured by DSC method, a melt flow rate of 1 to 500 g/10 min. per ASTM Method D-1238, and a solid density of 0.880 to 0.905 g/cc per ASTM Method D-1505. APAO polymers are a family of essentially amorphous low molecular weight homopolymers of propylene or copolymers of propylene with ethylene or butene or hexene.

The tackifying resins which are used in the adhesives of the present invention are those which extend the adhesive properties and improve the specific adhesion of the polymer. As used herein, the term "tackifying resin" includes:

(a) natural and modified rosin such as, for example, gum rosin, wood rosin, tall-oil rosin, distilled rosin, hydrogenated rosin, dimerized rosin and polymerized rosin;

(b) glycerol and pentaerythritol esters of natural and modified rosins, such as, for example, the glycerol ester of pale wood rosin, the glycerol ester of hydrogenated rosin, the glycerol ester of polymerized rosin, the pentaerythritol ester of pale wood rosin, the pentaerythritol ester of hydrogenated rosin, the pentaerythritol ester of tall oil rosin and the phenolic modified pentaerythritol ester of rosin;

(c) polyterpene resins having a softening point, as determined by ASTM method E28-58T, of from about 60° C. to 140° C., the latter polyterpene resins generally resulting from the polymerization of terpene hydrocarbons, such as the monoterpene known as pinene, in the presence of Friedel-Crafts catalysts at moderately low temperatures; also included are the hydrogenated polyterpene resins;

(d) copolymers and terpolymers of natural terpenes, e.g. styrene/terpene, α-methyl styrene/terpene and vinyl toluene/terpene;

(e) phenolic-modified terpene resins such as, for example, the resin product resulting from the condensation, in an acidic medium, of a terpene and a phenol;

(f) aliphatic petroleum hydrocarbon resins having Ring and Ball softening points of from about 60° to 140° C., the latter resins resulting from the polymerization of monomers consisting primarily of olefins and diolefins; also included are the hydrogenated aliphatic petroleum hydrocarbon resins; examples of such commercially available resins based on a $C_5$-olefin fraction of this type are "Wingtack 95" and "Wingtack 115" tackifying resins sold by Goodyear Tire and Rubber Company;

(g) aromatic petroleum hydrocarbons and the hydrogenated derivatives thereof;

(h) aliphatic/aromatic petroleum derived hydrocarbons and the hydrogenated derivatives thereof.

Mixtures of two or more of the above described tackifying resins may be required for some formulations. An example of a commercially available tackifying resin which is useful for the present invention includes the resin which is identified commercially by the trade designation Escorez 5600. This resin is a partially hydrogenated aliphatic aromatic hydrocarbon resin, and is available from Exxon Chemical Company.

A plasticizer can also be present in the adhesive composition in order to provide desired viscosity control without substantially decreasing the adhesive strength or the service temperature of the adhesive. A suitable plasticizer may be selected from the group which not only includes the usual plasticizing oils, such as mineral oil, but also olefin oligomers and low molecular weight polymers, glycol benzoates, as well as vegetable and animal oil and derivatives of such oils. The petroleum derived oils which may be employed are relatively high boiling temperature materials containing only a minor proportion of aromatic hydrocarbons. In this regard, the aromatic hydrocarbons should preferably be less than 30%, and more particularly less than 15%, by weight, of the oil. Alternately, the oil may be totally non-aromatic. The oligomers may be polypropylenes, polybutenes, hydrogenated polyisoprene, hydrogenated butadiene, or the like having average molecular weights between about 350 and about 10,000. Suitable vegetable and animals oils include glycerol esters of the usual fatty acids and polymerization products thereof. Other plasticizers may be used provided they have suitable compatibility Kaydol, a USP grade paraffinic mineral oil manufactured by Crompton Corporation, has also been found to be an appropriate plasticizer. As will be appreciated, plasticizers have typically been employed to lower the viscosity of the overall adhesive composition without substantially decreasing the adhesive strength and/or the service temperature of the adhesive. The choice of plasticizer can be useful in formulation for specific end uses (such as wet strength core applications).

Waxes can also be used in the adhesive composition, and are used to reduce the melt viscosity of the hot melt construction adhesives without appreciably decreasing their adhesive bonding characteristics. These waxes also are used to reduce the open time of the composition without effecting the temperature performance. Among the useful waxes are:

(1) low molecular weight, that is, 1000-6000, polyethylene having a hardness value, as determined by ASTM method D-1321, of from about 0.1 to 120 and ASTM softening points of from about 150° to 250° F.:

(2) petroleum waxes such as paraffin wax having a melting point of from about 130° to 170° F. and microcrystalline wax having a melting point of from about 135° to 200° F., the latter melting points being determined by ASTM method D127-60;

(3) atactic polypropylene having a Ring and Ball softening point of from about 120° to 160° C.;

(4) synthetic waxes made by polymerizing carbon monoxide and hydrogen such as Fischer-Tropsch wax; and (5) polyolefin waxes. As used herein, the term "polyolefin wax" refers to those polymeric or long-chain entities comprised of olefinic monomer units. These materials are commercially available from Eastman Chemical Co. under the trade name "Epolene." The materials which are preferred to use in the compositions of the present invention have a Ring and Ball softening point of 200° F. to 350° F. As should be understood, each of these wax diluents is solid at room temperature. Other useful substances include hydrogenated animal, fish and vegetable fats and oils such as hydrogenated tallow, lard, soya oil, cottonseed oil, castor oil, menhadin oil, cod liver oil, etc., and which are solid at ambient temperature by virtue of their being hydrogenated, have also been found to be useful with respect to functioning as a wax diluent equivalent. These hydrogenated materials are often referred to in the adhesives industry as "animal or vegetable waxes."

The adhesive also typically includes a stabilizer or antioxidant. The stabilizers which are useful in the hot melt adhesive compositions of the present invention are incorporated to help protect the polymers noted above, and thereby the total adhesive system, from the effects of thermal and oxidative degradation which normally occurs during the manufacture and application of the adhesive as well as in the ordinary exposure of the final product to the ambient environment. Such degradation is usually manifested by a deterioration in the appearance, physical properties and performance characteristics of the adhesive. A particularly preferred antioxidant is Irganox 1010, a tetrakis(methylene (3,5-di-teri-butyl-4-hydroxyhydrocinnamate))methane manufactured by Ciba-Geigy. Among the applicable stabilizers are high molecular weight hindered phenols and multifunctional phenols, such as sulfur and phosphorus-containing phenols. Hindered phenols are well known to those skilled in the art and may be characterized as phenolic compounds which also contain sterically bulky radicals in close proximity to the phenolic hydroxyl group thereof. In particular, tertiary butyl groups generally are substituted onto the benzene ring in at least one of the ortho positions relative to the phenolic hydroxyl group. The presence of these sterically bulky substituted radicals in the vicinity of the hydroxyl group serves to retard its stretching frequency and correspondingly, its reactivity; this steric hindrance thus providing the phenolic compound with its stabilizing properties. Representative hindered phenols include:

1,3,5-trimethyl-2,4,6-tris(3-5-di-tert-butyl-4-hydroxybenzyl) benzene;

pentaerythritol tetrakis-3(3,5-di-tert-butyl-4-hydroxyphenyl) propionate;

n-octadecyl-3(3,5-ditert-butyl-4-hydroxyphenyl) propionate;

4,4'-methylenebis(4-methyl-6-tert butylphenol);

4,4'-thiobis(6-tert-butyl-o-cresol);

2,6-di-tert-butylphenol;

6-(4-hydroxyphenoxy)-2,4-bis(n-ocytlthio)-1,3,5-triazine;

2,4,6-tris(4-hydroxy-3,5-di-tert-butyl-phenoxy)-1,3,5-triazine; di-n-octadecyl-3,5-di-tert-butyl-4-hydroxybenzylphosphonate;

2-(n-octylthio)ethyl-3,5-di-tert-butyl-4-hydroxybenzoate; and sorbitol hexa-(3,3,5-di-tert-butyl-4-hydroxy-phenyl) propionate.

The performance of these stabilizers may be further enhanced by utilizing, in conjunction therewith; (1) synergists such as, for example, as thiodipropionate esters and phosphites; and (2) chelating agents and metal deactivators as, for example, ethylenediaminetetraacetic acid, salts thereof, and disalicylalpropylenediimine.

The adhesive composition useful in the method of the present invention may be formulated using any of the techniques known in the art. A representative example of the prior art procedure involves placing all of the substances, in a jacketed mixing kettle, and preferably in a jacketed heavy duty mixer of the Baker-Perkins or Day type, and which is equipped with rotors, and thereafter raising the temperature of this mixture to a range of about 250° F. to 350° F. It should be understood that the precise temperature to be used in this step would depend on the melting point of the particular ingredients. The resulting adhesive composition is agitated until the polymers completely dissolve. A vacuum is then applied to remove any entrapped air.

Optional additives may be incorporated into the adhesive composition in order to modify particular physical properties. These additives may include colorants, such as titanium dioxide and fillers such as talc and clay as well as ultraviolet light (UV) absorbing agents and UV fluorescing agents.

Thermoplastic Film

The thermoplastic film 8 into which the molten adhesive is poured and/or film 18 which covers the adhesive may be any film which is meltable together with the adhesive composition and blendable into said molten adhesive and which will not deleteriously affect the properties of the adhesive composition when blended therewith. Suitable thermoplastic materials are well known and readily available and include ethylene based polymers such as ethylene acrylate, ethylene methacrylate, ethylene methyl acrylate, ethylene methyl methacrylate, an ethylene-styrene interpolymer (ESI), an ethylene acrylic acid, ethylene vinyl acetate, ethylene vinyl acetate carbon monoxide, and ethylene N-butyl acrylate carbon monoxide; polybutene-1 polymers; polyolefins such as high and low density polyethylene, polyethylene blends and chemically modified polyethylene, copolymers of ethylene and $C_1$ to $C_{10}$ mono- or di-unsaturated monomers, such as ethylene/octene copolymers, ethylene/hexene copolymers and ethylene/butene copolymers. Other thermoplastic materials include polyamides; polybutadiene rubber; polyesters such as polyethylene terephthalate and polybutylene terephthalate; thermoplastic polycarbonates; poly-alpha-olefins, including atactic polypropylene, isotactic polypropylene (IPP), syndiotactic polypropylene (SPP) and isotactic random copolymer (RCP) especially metallocene catalyzed RCPs (mRCP); thermoplastic polyacrylamides, such as polyacrylonitrile, and copolymers of acrylonitrile and other monomers such as butadiene and styrene; polymethyl pentene; polyphenylene sulfide; aromatic polyurethanes; styrene-acrylonitrile, acrylonitrile-butadiene-styrene, styrene-butadiene rubbers, acrylonitrile-butadiene-styrene elastomers; A-B, A-B-A, A-(B-A)$_n$-B, (A-B)$_n$-Y block copolymers wherein the A block comprises a polyvinyl aromatic block such as polystyrene, the B block comprises a rubbery midblock which can be polyisoprene, and optionally hydrogenated, such as polybutadiene, Y comprises a multivalent compound, and n is an integer of at least 3, and mixtures of said substances. Examples of these latter block copolymers including styrene-butadiene, styrene-butadiene-styrene, styrene-isoprene-styrene, styrene-ethylene-butylene-styrene and styrene-ethylene propylene-styrene. Polyvinyl alcohols and copolymers thereof as well as polyvinyl acetate and random copolymers thereof, and polyvinyl aromatic-rubber block copolymers can also be suitable.

Also contemplated for use as the film material for lining the mold 3 or covering mold 3 are hot melt adhesives such as those described in European patent application EP557573A2. In particular, a blend of styrene-isoprene-styrene (SIS) copolymer, resin, oil, wax and antioxidant/stabilizer may be used, but other blends (e.g. blends using polymers and/or copolymers other than SIS) may be used so long as they meet the criteria set forth herein.

The films may, if desired, contain antioxidants for enhanced stability as well as other optional components such as fatty amides or other processing aids, anti-stats, stabilizers, plasticizers, dyes, pigments, perfumes, fillers and the like to increase the flexibility, handleability, visibility or other useful property of the film.

The specific thermoplastic film utilized will depend, in large part, on the composition and melting point of the hot melt adhesive being packaged, with the softening point of the film generally being about 90° C. to 130° C. Particularly preferred for most hot melt adhesives are thermoplastic films of low density polyethylene or poly(ethylene vinyl acetate) wherein the amount of vinyl acetate is 0 to 10%, preferably 3 to 5%, by weight. Especially preferred are such films having a melt flow index of 0.5 to 10.0; a softening point of 100° C. to 120° C. and a specific gravity of 0.88 to 0.96. One example of these films is available commercially from Tyco Plastics under the Armin 501 trade name. Other preferred films are composed of SPP or mRCP polymers.

The thickness of the film utilized generally varies between about 0.1 mil to 5 mil, preferably 0.5 mil to 4 mil. It is further preferred that the thermoplastic film comprise not more than about 1.5% by weight of the total adhesive mass and that it optimally vary from 0.2 to 1.0% by weight of the mass in order to prevent undue dilution of the adhesive properties.

The Mold

The pan or mold 3 into which the thermoplastic film is placed and into which the molten adhesive is to be poured may comprise any rigid, self supporting material. The mold or pan 3 is generally formed from rigid plastic, e.g. polyethylene terephthalate (PET), acrylonitrile/butadiene/styrene polymers or polypropylene, or from metallic substrates such as copper, tin, stainless steel or aluminum. The inner surfaces of the pans or molds may also be coated with a release layer or non-stick layer such as the fluoropolymer "Teflon" available from DuPont. The size and internal configuration of the cavity in each mold or pan 3 varies according to the size and configuration of the desired hot melt adhesive block. In general each mold or pan is approximately 3"×3"×11" in dimension and often a series of molds or pans are formed from one contiguous plastic, cellulosic or metal sheet.

The Carrier

Figure 5:
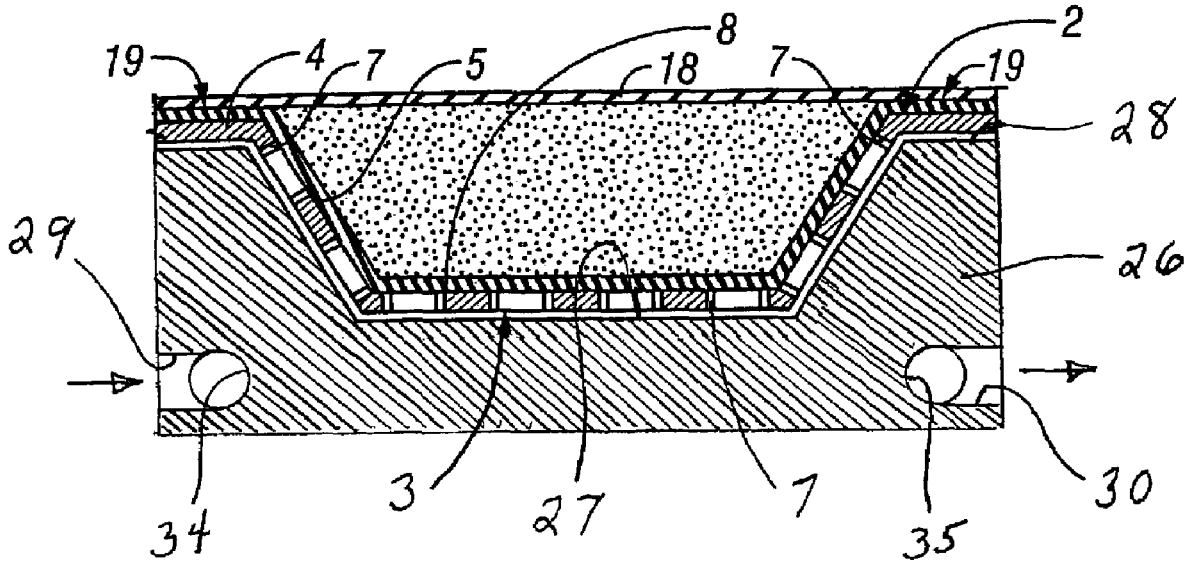
FIG. 5 is a cross-section view illustrating a second embodiment of the present invention in the form of a pan and carrier assembly wherein the carrier has internal cooling passageways.

As described herein, the pan or mold 3 is received within and supported by a carrier as it moves downstream in the process of the present invention. The carrier may comprise any type of rigid apparatus that not only supports pan or mold 3, but also acts as a heat sink to effectively and rapidly remove, dissipate or absorb the heat from the molten adhesive within pan 3. The carrier is preferably in the form of the second pan 10 as previously described herein so that the cooling medium can contact directly against the external surfaces of pan 10. However, the carrier could also take on other forms wherein the cooling medium contacts one or more internal surfaces of the carrier. For example, FIG. 5 illustrates an alternate embodiment where the carrier is in the form of a relatively solid core member or block 26 of material which includes a cavity 27 in its upper surface 28 for receiving and supporting pan 3. To provide cooling, core 26 includes internal passageways 34, 35 communicating with inlet 29 and outlet 30 respectively through which a cooling medium, preferably water, passes. The internal passageways 34, 35 crisscross and/or traverse the interior of core member 26 in any desired pattern to remove heat from the molten adhesive. Alternately, a jacketed core member 36 such as that illustrated in FIG. 6 may be employed as the carrier 36. In such an embodiment, the carrier may once again be pan-shaped similar to pan 10, but further includes an exterior jacket 31 having an inlet 32 and an outlet 33 through which a cooling medium, preferably water, passes.

Figure 6:
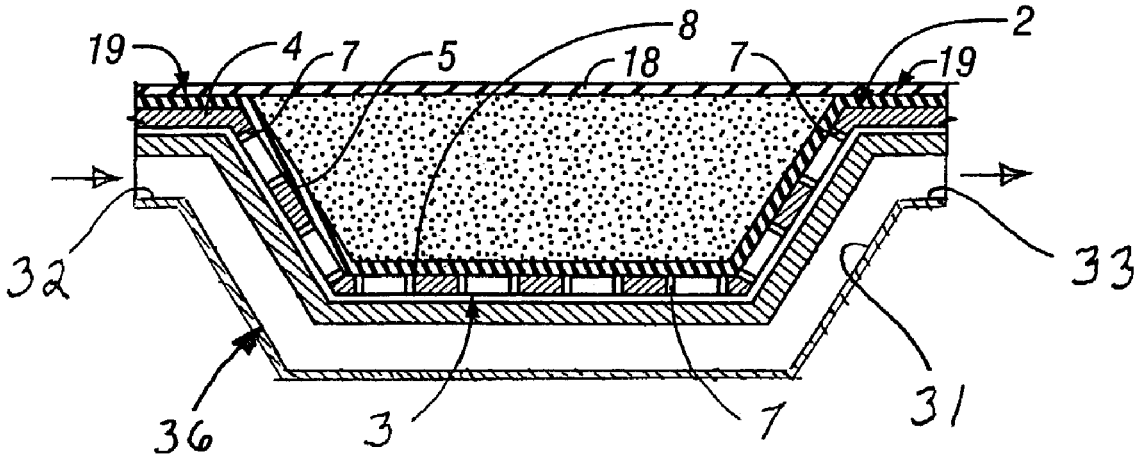
FIG. 6 is a cross-sectional view illustrating a third embodiment of the present invention in the form of a pan and carrier assembly wherein the carrier has an external cooling jacket.

It is also important to note that the embodiments illustrated in FIGS. 5 and 6 would not require use of trough 15. Thus, individual carriers, or groups of carriers, could remain stationary while the adhesive cools, or could be moved downstream via a conveyor system, rather than float in a trough until the desired temperature for the adhesive is reached. Finally, it is to be noted that the configurations of the carriers shown in FIGS. 5 and 6 are not critical. Thus, practically any configuration for the carrier may be employed so long as it supports pan or mold 3 and cools the adhesive contained therein.

Cooling Medium

Cooling may be accomplished by any medium which acts to remove, absorb or dissipate heat from the molten adhesive. The cooling medium may be either a liquid or a gas, and may be used at ambient temperature or chilled to any desired degree below ambient. The cooling medium is preferably a liquid such as water, a water-ethylene glycol blend or even liquid nitrogen or liquid carbon dioxide. However, as noted above, the cooling medium could also be a gas such as air, oxygen, carbon dioxide, nitrogen or argon.

EXAMPLE

The following tests were performed to determine the compatibility of various thin films when ultimately mixed with an adhesive composition to determine whether the films have physical characteristics which are compatible with and do not substantially adversely affect the adhesive characteristics of a molten mixture of said adhesive and said material, and whereby said mixture is substantially compatible with the operation of hot melt application equipment.

Film Compatibility Study

H2494 adhesive with various films, each at two concentrations

Procedure:

Melt adhesive at 160° C.

Add 200 g melted adhesive to a container, next add small pieces of film and an additional 100 g of melted glue.

Agitate at slow speed, approximately 50 rpm with agitator. Maintain temperature at 160° C.

Inspect sample every 10 minutes.

Note time when film is completely dissolved.

| Example | Film | % Film | Adhesive (g) | Film (g) | Observations (Minutes until film dissolves) | Viscosity @ 325 F. (cP) | Softening Point (° F.) |
|---|---|---|---|---|---|---|---|
| 1 (Control) | Armin 501 | 0.5 | 300 | 1.5 | Time 100 min. | 3235 | 197 |
| 2 (Control) | | 1 | 300 | 3 | Time 145 min. | 3735 | 197 |
| 3 | DE 402.01 | 0.5 | 300 | 1.5 | Time 140 min. Small white balls of film appear in glue but they dissolve. | 3445 | 197 |
| 4 | | 1 | 300 | 3 | Time 175 min. Some balls of film appear in the adhesive during processing. | 3980 | 195 |
| 5 | Finaplas 1751 | 0.5 | 300 | 1.5 | Time 45-55 min. Film dissolves readily. | 3620 | 196 |
| 6 | | 1 | 300 | 3 | Time 70-80 min. Film dissolves readily. | 3900 | 197 |
| 7 | Finacene EOD 01-06 | 0.5 | 300 | 1.5 | Time 70-80 min. After 50 min a small ball of film appears but dissolves. | 3690 | 198 |
| 8 | | 1 | 300 | 3 | Time 90-100 min. After 50 min a small ball of film appears and slowly dissolves. | 4190 | 199 |

Products all appear uniform after film dissolution.

| Description of raw materials | |
|---|---|
| H2494 | Hot melt adhesive based on high styrene SIS block copolymer compounded with aromatic modified hydrocarbon resin and mineral oil. More complete description can be found in U.S. Pat. No. 5,149,741. Available from Bostik Findley, Inc. |
| Armin 501 | Low vinyl acetate (4 percent) EVA based packaging film. Commonly used for "packageless" packages of hot melt adhesive. Available from Tyco Plastics. Used as a "Control" film, DSC melting point 112° C. Melt index 1.5. |
| DE 402.01 | Ethylene-styrene interpolymer available from Dow Chemical Co. 20 percent styrene. DSC melting point 90° C. Melt index 10. |
| Finaplas 1751 | Syndiotactic polypropylene film available from Atofina Petrochemicals, Inc. 10% ethylene DSC melting point 130° C. Melt index 25. |
| Finacene EOD 01-06 | Metallocene catalyzed random copolymer film available from Atofina Petrochemicals, Inc. 6% ethylene DSC melting point 112° C. Melt index 7. |

The results of the above tests show that the adhesive properties of the adhesive blocks are unaffected by the admixture with the packaging material. Similar results would also be obtained when packaging other hot melt adhesive formulations. The changes observed in viscosity and melting point are not considered significant.

We claim:

1. A dual component molding assembly for preparing a packaged hot melt adhesive, comprising:

a carrier having a mold-receiving cavity formed therein;

a rigid mold disposed in said mold-receiving cavity, said mold having an open top cavity formed therein for holding a mass of molten hot melt adhesive and said open top cavity is defined by a sidewall and bottom wall composed of a thermally conductive solid material, said sidewall and bottom wall being perforated with a plurality of openings formed therethrough communicating with said open top cavity; and a film of thermoplastic material lining said open top cavity of said mold, wherein said mold and film are removable from said carrier.

2. The molding assembly of claim 1 wherein said mold comprises a pan.

3. The molding assembly of claim 1 wherein said carrier comprises a pan.

4. The molding assembly of claim 1 wherein said mold-receiving cavity is configured with substantially identical dimensions as said open top cavity to enable said mold to be nested in said carrier.

5. The molding assembly of claim 1 wherein said carrier comprises a core member having internal cooling passageways formed therein.

6. The molding assembly of claim 1 wherein said carrier comprises a jacketed core member.

7. The molding assembly of claim 1 wherein said film of thermoplastic material is selected from the group consisting of ethylene acrylate, ethylene methacrylate, ethylene methyl acrylate, ethylene methyl methacrylate, an ethylene-styrene interpolymer, an ethylene acrylic acid, ethylene vinyl acetate, ethylene vinyl acetate carbon monoxide, ethylene N-butyl acrylate carbon monoxide; polybutene-1 polymers; polyolefins, high and low density polyethylene, polyethylene blends, chemically modified polyethylene, copolymers of ethylene and $C_1$ to $C_{10}$ mono- or diunsaturated monomers, ethylene/octene copolymers, ethylene/hexene copolymers, ethylene/butene copolymers, polyamides, polybutadiene rubber, polyesters, polyethylene terephthalate, polybutylene terephthalate, thermoplastic polycarbonates, poly-alpha-olefins, atactic polypropylene, isotactic polypropylene, syndiotactic polypropylene, isotactic random copolymers, metallocene catalyzed isotactic random copolymers; thermoplastic polyacrylamides, polyacrylonitrile, copolymers of acrylonitrile and other monomers such as butadiene or styrene, polymethyl pentene, polyphenylene sulfide, aromatic polyurethanes; styrene-acrylonitrile, acrylonitrile-butadiene-styrene, styrene-butadiene rubbers, acrylonitrile-butadiene-styrene elastomers; A-B, A-B-A, A-$(B\text{-}A)_n$-B, $(A\text{-}B)_n$-Y block copolymers wherein the A block comprises a polyvinyl aromatic block such as polystyrene, the B block comprises a rubbery midblock which can be polyisoprene, and optionally hydrogenated, such as polybutadiene, Y comprises a multivalent compound, and n is an integer of at least 3, polyvinyl alcohols and copolymers thereof, polyvinyl acetate and random copolymers thereof, and polyvinyl aromatic-rubber block copolymers.

8. The molding assembly of claim 1 wherein said rigid mold is composed of aluminum.

* * * * *